US012151856B2

(12) United States Patent
Dekocker et al.

(10) Patent No.: US 12,151,856 B2
(45) Date of Patent: Nov. 26, 2024

(54) MODULAR HANDLE FOR SECONDARY PACKAGING

(71) Applicant: Anheuser-Busch InBev S.A., Brussels (BE)

(72) Inventors: Wim Dekocker, Leuven (BE); Keenan Thompson, Leuven (BE)

(73) Assignee: ANHEUSER-BUSCH INBEV S.A., Brussels (BE)

( * ) Notice: Subject to any disclaimer, the term of this patent is extended or adjusted under 35 U.S.C. 154(b) by 803 days.

(21) Appl. No.: 17/257,028

(22) PCT Filed: Jul. 5, 2019

(86) PCT No.: PCT/EP2019/068162
§ 371 (c)(1),
(2) Date: Dec. 30, 2020

(87) PCT Pub. No.: WO2020/008060
PCT Pub. Date: Jan. 9, 2020

(65) Prior Publication Data

US 2021/0122517 A1 Apr. 29, 2021

Related U.S. Application Data

(60) Provisional application No. 62/694,552, filed on Jul. 6, 2018.

(30) Foreign Application Priority Data

Jul. 6, 2018 (BE) ..... 2018/5475

(51) Int. Cl.
*B65D 5/46* (2006.01)
*B65D 33/10* (2006.01)

(52) U.S. Cl.
CPC ..... *B65D 5/46032* (2013.01); *B65D 33/10* (2013.01)

(58) Field of Classification Search
CPC B65D 5/46032; B65D 33/10; B65D 5/46024; B65D 33/06; B65D 2571/00493;
(Continued)

(56) References Cited

U.S. PATENT DOCUMENTS 2,021,559 A 11/1935 Lengsfield
2,109,034 A 2/1938 Seifer
(Continued)

FOREIGN PATENT DOCUMENTS

DE 9302227 U1 5/1993
FR 2580591 A1 10/1986
WO WO-9202423 A1 2/1992

OTHER PUBLICATIONS

Chinese Office Action dated Mar. 17, 2022 for corresponding Chinese Application No. 201980058411.7.
(Continued)

*Primary Examiner* — Christopher R Demeree
(74) *Attorney, Agent, or Firm* — ARENTFOX SCHIFF LLP

(57) ABSTRACT

The present disclosure provides a handle having smoothened edges. The handle includes a body portion formed of an elongated piece of material having a pair of side edges defining a width of the body portion. The body portion includes a gripping region extended towards and/or between a first attachment region and/or a second attachment region. Further, each of the side edges of the gripping region has a cutting index lower than a cutting index of the remaining part of the gripping region such that the gripping region is soft and comfortable at the edges for a user to hold.

8 Claims, 5 Drawing Sheets

(58) Field of Classification Search
CPC ..... B65D 2571/00512; B65D 5/46016; B65D 5/46192; B65D 25/2873
USPC ..... 229/117.23, 117.24, 117.25, 117.19, 229/117.22, 117.13, 117.26, 116.1, 920, 229/914, 117.12, 199; 220/755, 759, 769, 220/770, 775; 206/427, 549; 383/4
See application file for complete search history.

(56) References Cited

U.S. PATENT DOCUMENTS 2,401,664 A * 6/1946 Robins ..... B65D 5/46024 16/423
2,868,433 A * 1/1959 Anderson, Jr. .... B65D 5/46192 229/199
3,030,002 A * 4/1962 Ringler ..... B65D 5/46016 229/117.24
3,270,939 A 9/1966 Ebelhardt
3,774,836 A * 11/1973 Nunn ..... B65D 5/46016 229/117.24
3,801,012 A * 4/1974 Thelen ..... B65D 5/46016 229/117.22
4,339,070 A * 7/1982 Davies ..... B65D 5/46192 229/220
6,866,906 B2 3/2005 Williams et al.
2007/0199837 A1* 8/2007 Justice ..... B65D 85/62 206/215
2007/0245521 A1 10/2007 Chehebar
2012/0145733 A1 6/2012 Heilman et al.
2021/0269192 A1* 9/2021 Thompson ..... B65D 71/36

OTHER PUBLICATIONS

International Search Report PCT/ISA/210 for International Application No. PCT/EP2019/068162 Dated Sep. 18, 2019.
International Preliminary Report on Patentability for PCT/EP2019/068162 dated Jan. 21, 2021.
Search Report for Belgium Application No. 201805475 dated Mar. 6, 2019.
Office Action received for Mexican Patent Application No. MX/a/2021/000121, mailed on Apr. 25, 2024, 10 pages.

* cited by examiner

MODULAR HANDLE FOR SECONDARY PACKAGING

CROSS-REFERENCE TO RELATED APPLICATIONS

This application is a national phase under 35 U.S.C. § 371 of PCT International Application No. PCT/EP2019/068162 which has an International filing date of Jul. 5, 2019, which claims priority to Belgium Patent Application No. BE2018/5475, filed Jul. 6, 2018, and U.S. Provisional Application No. 62/694,552, filed Jul. 6, 2018 the entire contents of each of which are hereby incorporated by reference.

TECHNICAL FIELD

The present disclosure generally relates to handles for secondary packages; and more particularly relates to comfortable to grip handles.

BACKGROUND

In the recent years, there has there has been a many-fold increase in the trend of utilizing different kind of secondary packages such as carry bags and/or cartons and/or the like, for facilitating carriage of the goods out of the retail establishment such as supermarkets, retail shops, and the like. Further, various kind of cartons have been increasingly used for packaging multiple containers enclosing liquid foods such as for example, water, beer, beverages, etc. Such bags and cartons are provided with different kind of handles for facilitating lifting of these packages Accordingly, as discussed above, various kind of handle structure have been developed for such packages including carry bags, cartons, and the like. These handle structure includes various strap-based handles, integral flap-based handles, paper handles, elements articulated means attached to one of the package walls, and/or different kind of separate handle elements attached to the cartons/bags, and the like.

While all of currently known handles provide one advantage or the other, there has been a common shortcoming faced which is when these handles are utilized to carry packages that are either heavily loaded or particularly when they must be carried over great distances. In such instances, these handles having generally sharp and/or irregular edges causes discomfort to a user's hand/finger/palm which can become painful after a fairly short period of time. Further, these may cause cuts and other kinds of injuries to user's hand/fingers.

Accordingly, it was desired to provide handles which would be strong as well as comfortable to grip. Further, for cost and environmental considerations, such handle needs to be formed from as little material as possible and cause as little wastage in the materials from which they are formed as possible. Numerous efforts have therefore been imparted to manufacture handles having the above-mentioned characteristics.

In some instances, integrally molded handles formed of plastics/thermoplastics having generally softened/curved/smoothened edges were provided. While such plastic based handles having molded edges are in use for long time now, for environmental reasons and recyclability, these are not preferred anymore and the trend is shifting towards recyclable paper/carton-based handles.

In a preferred embodiment, the handles comprise metal, preferably aluminum, or may even consist thereof. The material choice is advantageous as it is already present for production of the containers, can be produced easily, allows easy processing (for instance printing, etching, etc.), is flexible, lightweight, strong and resistant to many environmental conditions.

Recently, various kind of alternates have therefore been developed which have tried to overcome the problem of sharp edges within paper/carton-based handles. In some developments, as disclosed in U.S. Pat. No. 3,912,140, different kind of hand grips have been suggested, which when applied to the paper handles allows a user to grip the handles free from the sharp edges discomfort. However, this can be costly, inconvenient, and are cumbersome to apply. Further, such hand grips do not remain attached to the package handles, resulting in misplacement thereof.

In some other developments, as disclosed within U.S. Pat. No. 6,796,002, a cushioning padding has been suggested which when attached to a bottom portion of handle provides soft handles. However, these does not overcome the problem of sharp edges and are therefore not preferred.

In yet other developments, particularly within handles which are formed integrally with the carton and using foldable blank there has been provided a couple of techniques for avoiding the problem of sharp edges. In some instances, as disclosed in U.S. Pat. No. 4,538,759, the handle of carton is formed of a multi ply structure having two or more panels in overlapping relationship with a handle slot for holding the handle. However, since such handle requires a user to insert his or her hand into the slots formed, therefore are uncomfortable to use, and indeed difficult to employ. In other instances, as disclosed in European Patent NO 2102073, the handle may include a plurality of handle flaps that are partially separable from the handle to provide comfortable gripping surfaces for a user's hand. While all such foldable blank is applicable only to packages made of foldable blank, and therefore not applicable to other kind of packages. Further, these flaps/multi-ply-based handles tend to move into a vertical position when utilized to lift heavy weights and therefore, the sharp edges are positioned vertically. In this position, the sharp edges dig into the user's fingers and palm, causing extreme discomfort.

Accordingly, as can be seen from the foregoing discussion, none of the existing solution completely overcomes the problem of sharp edges-based discomfort and there still exists a need for an improved handle which while being cost effective and strong, overcomes the problem of sharp edges and is comfortable to be used for carrying heavy loads for as long as desired.

SUMMARY

In one aspect of the present disclosure, a handle is provided including a body portion formed of an elongated piece of material having a pair of side edges defining a width of the body portion. The body portion includes a gripping region extended towards and/or between a first attachment region and/or a second attachment region. Further, each of the side edges of the gripping region has a cutting index lower than a cutting index of the remaining part of the gripping region such that the gripping region is soft and comfortable at the edges for a user to hold. Such cutting index is known in the art as explained in U.S. Pat. No. 6,866,906 B2 (International Paper Co).

Not considering the above state of the art definition for the cutting index, the person skilled in the art would understand the "cutting index" to reflect a combination of the sharpness of an object with its rigidity, resulting in its propensity to inflict a cut on another material when brought into contact therewith.

In one embodiment, a handle having smoothened edges is provided wherein each of the side edges of the gripping region has a smoothness higher than a smoothness of the remaining part of the gripping region such that the gripping region is soft and comfortable at the edges for a user to hold.

In another embodiment, each of the side edges of the gripping region may have a surface roughness lower than a surface roughness of the remaining part of the gripping region such that the gripping region is soft and comfortable at the edges for a user to hold.

In an embodiment according to the present invention, the side edges at the gripping region of the body portion has a thickness substantially lesser than the thickness of the side edges at each of the attachment region of the body portion.

In another embodiment according to the present invention, the side edges of the gripping region may be inclined towards the remaining part of the gripping region.

In particular, the side edges of the gripping region may have a generally right-trapezoidal cross-sectional shape.

Alternatively, the side edges of the gripping region have a generally semi-circular cross-section sectional shape.

Generally, the gripping region is a single layer structure, or may be a multilayer structure.

Possibly, the gripping region includes a hand engaging region extending between a pair of raised tactile features, each of the tactile feature adapted to facilitate prevention of movement of the user's hand away from the gripping region.

Optionally, the gripping region includes a cushioning pad affixed onto a lower surface thereof adapted to provide a cushioning impact when held by the user.

Alternatively, the gripping region includes a polymer coated onto the lower surface thereof adapted to provide a cushioning impact when held by the use The secondary package may be a carton and/or a bag formed of a material selected from one or more of but not limited to all kind of papers, paperboard, fiberboard, cardboard, corrugated board, foldable blank, fabrics, plastics, and the like.

Further, the body portion of the handle may be made of any material selected from but not limited to a single layer or a multilayer structure of all kind of papers, cardboard, carton, fiber board, corrugated board, plastic, and the like In another aspect of the invention, a method for manufacturing a handle having generally smoothened edges is provided. The method includes receiving a body portion of the handle having a gripping region extended towards and/or between a first attachment region and/or a second attachment region. The method further includes smoothening each of the side edges at the gripping region using one or more mechanical mechanisms such that the gripping region is soft and comfortable at the edges for a user to hold.

Generally, the method includes attaching the handle onto a secondary package at each of its attachment region. As such, the handle is to be understood as modular.

Optionally, the method includes an additional step of coating a lower surface of the gripping region with a polymer material adapted to provide a cushioning impact when held by the user, Further optionally, the polymer material may be selected from one or more of but not limited to group of polyethylene specifically low density polyethylene, polypropylene, polyester, in particular polyalkylene terephthalates and one or more polymers selected from polymer of said elastomeric film is selected from the group consisting of poly(ethylene-butene), poly(ethylene-hexene), poly(ethylene-octene), poly (ethylene-propylene), poly(styrene-butadiene-styrene), poly (styrene-isoprene-styrene), poly(styrene-ethylene-butylene-styrene), poly(ester-ether), poly(ether-amide), poly (ethylene-vinylacetate), poly(ethylene-methylacrylate), poly (ethylene-acrylic acid), poly(ethylene butylacrylate), polyurethane, poly(ethylene-propylene-diene), and ethylene-propylene rubber, EPM (ethylene propylene rubber, a copolymer of ethylene and propylene) and EPDM rubber (ethylene propylene diene rubber, a terpolymer of ethylene, propylene and a diene-component), Epichlorohydrin rubber (ECO), Polyacrylic rubber (ACM, ABR), Silicone rubber (SI, Q, VMQ), Fluorosilicone Rubber (FVMQ), Fluoroelastomers (FKM, and FEPM) Viton, Tecnoflon, Fluorel, Aflas and Dai-El.

Potentially, the method further includes a step of forming a pair of raised tactile feature, each on one side of a hand engaging region.

Further potentially, the pair of tactile feature may be formed by coating using a tactile material selected from one or more varnishes and/or various tactile coating compositions having a blend of materials selected from one or more of but not limited rubberized material, silica, one or more binders, one or more epoxy functional groups—containing, acrylate monomer and the silicone macro monomer, vinyl monomers such as the vinyl styrene, vinyl acetate, vinyl propionate, vinyl benzoate, vinyl toluene, and various other suitable polymers.

Potentially, the mechanical mechanism for smoothening the side edges may be selected from one or more of but not limited to crushing and/or crimping and/or stamping and/or embossing and/or the like.

The mechanical mechanism may comprise cutting the handle at at least the side edges with a profiled cutting implement, such as a profiled knife, with a hollow blade on at least one side, resulting in a convex (rounded) side edge. Doing so will result in a simultaneous cutting and crushing action of the knife, resulting in a more rounded side edge, thus having a lower cutting index.

Optionally, each of the step of the method may be performed in any desired order.

In another aspect of the invention, a secondary package employing a handle with generally smoothened edges is provided. The secondary package includes a plurality of walls including a top wall, a bottom wall and a plurality of sidewalls defining an inner surface there within. The secondary package further includes one or more handle configured thereon for securely and comfortably gripping and/carrying the package.

Generally, the secondary package is a carton formed of a material selected from but not limited to a paperboard, a cardboard, plastic, paper, hybrid material, and any combination thereof. Alternatively, the secondary package may be an open bag formed of a material selected from but not limited to a paperboard, a cardboard, plastic, paper, hybrid material, and any combination thereof.

Most preferably, the secondary package comprises a carton and/or a bag formed of a material selected from paper, paperboard, fiberboard, cardboard, or corrugated board, such that the package including handle is all paper-based.

Possibly, the secondary package may be of any suitable geometric shape such as cuboidal, cubical, spherical, circular and the like.

Optionally, the secondary package includes one or more handle openings configured onto one or more of the plurality of walls.

Further optionally, the handle may be installed within an inner surface of the secondary package such that it is accessible through one or more handle openings.

Alternatively, the handle may be attached onto an outer surface of the secondary package.

The details of one or more implementations are set forth in the accompanying drawings and the description below. Other aspects, features and advantages of the subject matter disclosed herein will be apparent from the description, the drawings, and the claims.

DETAILED DESCRIPTION

As required, a schematic, exemplary-only embodiment of the present application is disclosed herein; however, it is to be understood that the disclosed embodiment is merely exemplary of the present disclosure, which may be embodied in various and/or alternative forms. Specific structural and functional details disclosed herein are not to be interpreted as limiting, but merely as a basis for the claims and as a representative basis for teaching one skilled in the art to variously employ the present disclosure in virtually any appropriately detailed structure.

Aspects, advantages and/or other features of the exemplary embodiment of the disclosure will become apparent in view of the following detailed description, which discloses various non-limiting embodiments of the invention. In describing exemplary embodiments, specific terminology is employed for the sake of clarity. However, the embodiments are not intended to be limited to this specific terminology. It is to be understood that each specific portion includes all technical equivalents that operate in a similar manner to accomplish a similar purpose.

Exemplary embodiments may be adapted for many different purposes and are not intended to be limited to the specific exemplary purposes set forth herein. Those skilled in the art would be able to adapt the exemplary-only embodiment of the present disclosure, depending for example, on the intended use of adapted embodiment. Moreover, examples and limitations related therewith brought herein below are intended to be illustrative and not exclusive. Other limitations of the related art will become apparent to those of skill in the art upon a reading of the following specification and a study of the related figures.

The present application discloses a handle having smoothened edges for use with one or more secondary packages such as bags and/or cartons. The handle while being portable and strong, is comfortable for being held by a user to carry the heavy loads of the secondary packages for a longer duration of time, without causing any discomfort to the user's hand. It should be understood that embodiments of the present invention may be applied in combination with various type of packages irrespective of size, shape and materials, used in the beverage industry. Further, the present invention may be used in any other industry for facilitating easy handling of one or more packages, items grouped in a single package, without deviating from the scope of the invention.

Figure 1:
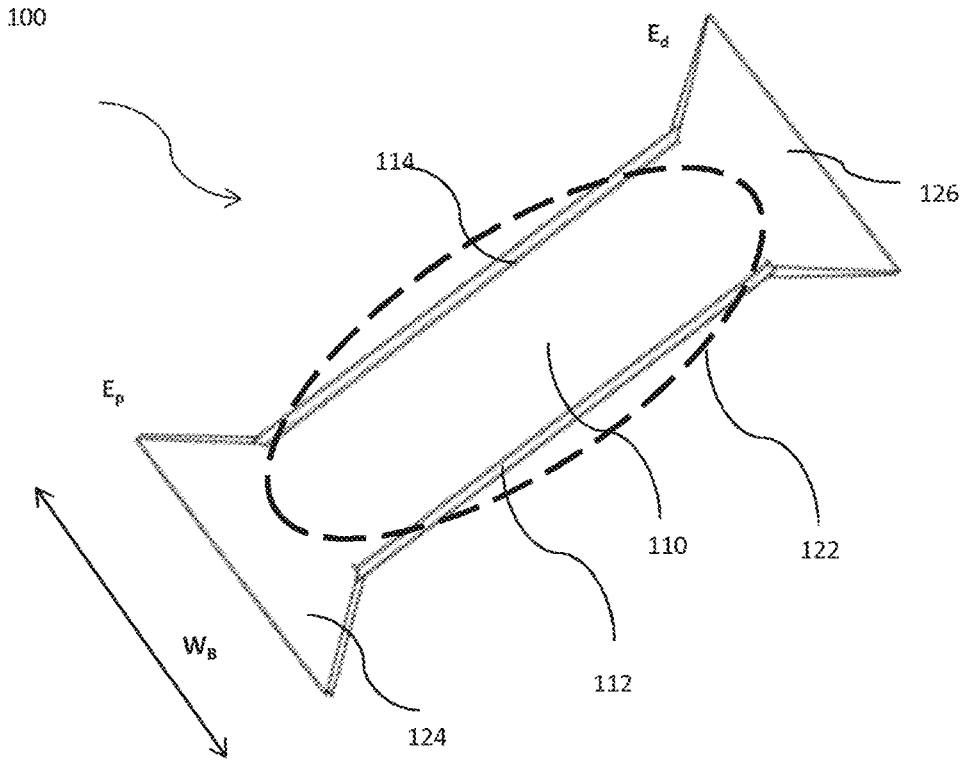
FIG. 1 illustrates a schematic diagram representing a handle, in accordance with a preferred embodiment of the present disclosure.

FIG. 1 illustrates a schematic diagram displaying basic components of the handle of the present disclosure. As illustrated in FIG. 1, the present disclosure provides a handle for use a secondary package [not shown] adapted to hold a plurality of items such as beverage containers, food items, house hold essentials, and the like. The handle 100 includes a body portion 110. The body portion 110 is formed of an elongated piece of material extended between a proximal end $E_p$ and a distal end $E_d$, and having a pair of side edges 112 and 114 defining a width $w_B$ thereof. The body portion 110 includes a gripping region 122 extending towards and/or between a first attachment region 124 and/or a second attachment region 126. Each of the attachment regions 124, 126 is adapted to be attached and/or lockingly receive within a wall of a secondary package. Each of the side edges 112 and 114 of the gripping region 122 has a cutting index lower than a cutting index of the remaining part of the gripping regions such that when lifted by a user, the gripping region 122 is soft and comfortable at the edges 112,114 for the user to hold.

Each of the side edges 112 and 114 of the gripping region 122 may have a smoothness higher than a smoothness of the remaining part of the gripping regions such that when lifted by a user, the gripping region 122 is soft and comfortable at the edges 112,114 for the user to hold.

Further, each of the side edges 112 and 114 of the gripping region 122 may have a surface roughness lower than a surface roughness of the remaining part of the gripping regions such that when lifted by a user, the gripping region 122 is soft and comfortable at the edges 112,114 for the user to hold.

The handle 100 of the current disclosure is generally configured to be installed within the secondary package either by attaching directly onto one of its wall using a suitable attachment means. Alternatively, the handle 100 may be utilized in combination within a handle assembly [now shown], generally pocket based, which may then be installed within the secondary package.

Figure 2:
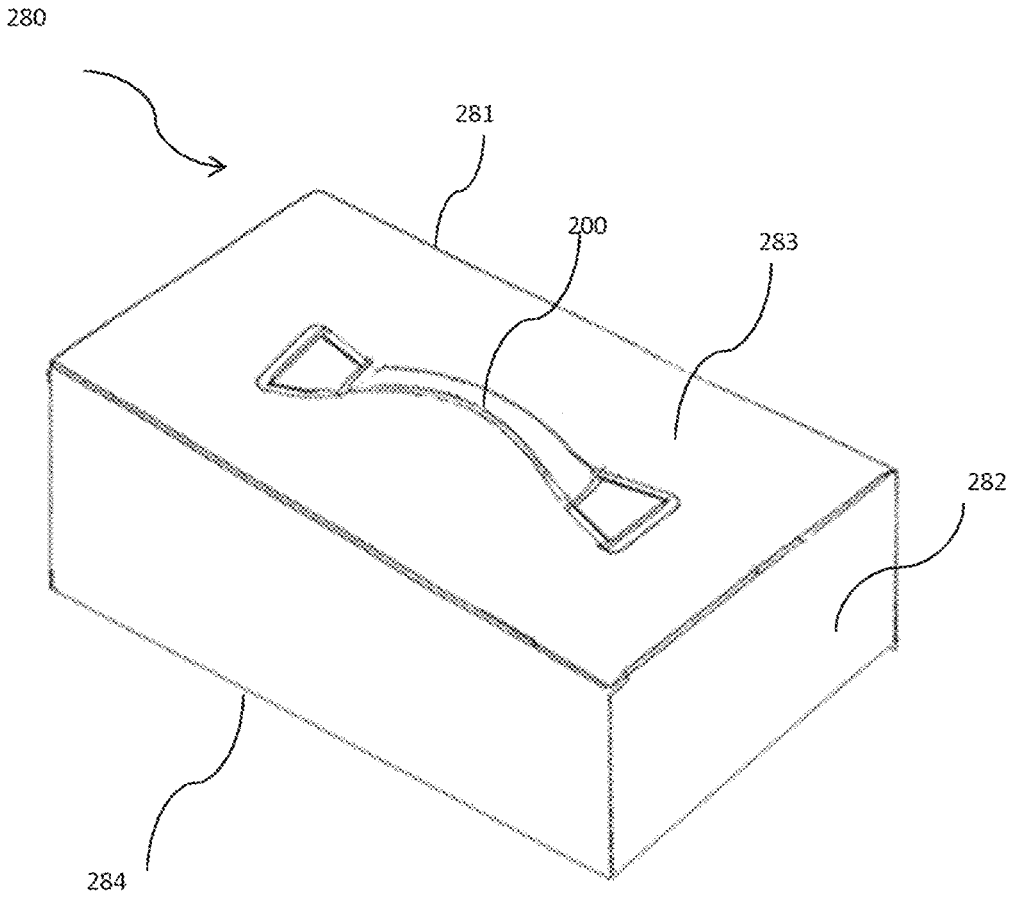
FIG. 2 illustrates an exemplary secondary package employing one or more handles, in accordance with a preferred embodiment of the present disclosure.
Figure 3:
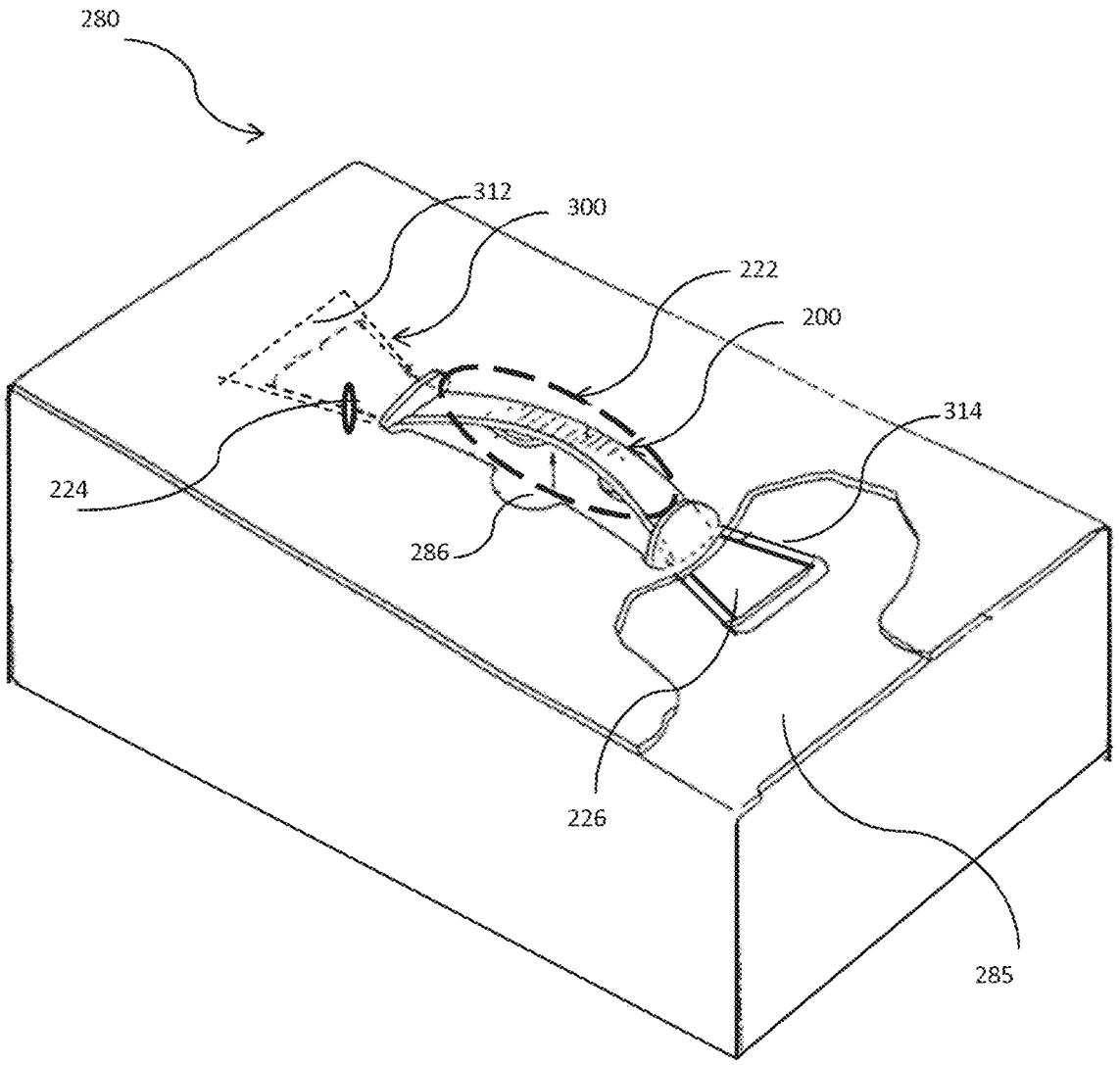
FIG. 3 illustrates another exemplary secondary package employing one or more handles, in accordance with another embodiment of the present disclosure.

In description of the FIG. 2-3 that follow, elements common to the schematic system will have the same number designation unless otherwise noted. In a first embodiment, as illustrated in FIG. 2, a secondary package 280 employing a handle 200 is provided. In a preferred embodiment, secondary package 280 includes a carton 281 having a plurality of sidewalls 282 extending between a top wall 283, and a bottom wall 284, defining an inner surface 285 there within.

It is to be contemplated that while the secondary package is disclosed to be a carton 281 generally formed a material selected from one or more of but not limited to any desired material such as including all kind of papers, fiberboard, corrugated board, foldable blanks, plastic, hybrid material, or any combinations thereof, any known housing formed by any known mechanism and suitable for use in accordance with the current disclosure without deviating from the scope thereof, may be used. Further, it should be understood that the secondary package 280 may be formed in any desired shape such as various differently shaped containers, spherical holders, circular boxes, and so on. For example, in some embodiments, the secondary package 280 may be an open bag generally known in the art, used for holding plurality of content therein. Generally, in such embodiments, the secondary package 280 includes more than one handle 200, and preferably two handles 200, each installed on an opposite sidewall 282 of the secondary package 280.

Further, the shape and size, including the height of the secondary package 280 may be varied depending on the design constraints and requirements for its application. For example, within the instances when the secondary package is a carton 281 adapted to house twelve containers in one layer in a 3×4 arrangement the carton is dimension accordingly. Further, in other instances, the secondary package 280 may be sized and shaped to hold same and/or different kind of items in a single layer, more than two layers, and/or in different row/column arrangements As disclosed earlier, the handle 200 includes a body portion 210. The body portion 210 is formed of an elongated piece of material extended between a proximal end $E_p$ and a distal end $E_{d\ and}$ having a pair of side edges 212 and 214 defining a width $_{wB}$ of the body portion 210 The body portion 210 includes a gripping region 222 extending towards and/or between a first attachment region 224 and/or a second attachment region 226.

In a preferred embodiment of the present invention, the gripping region 222 of the body portion 210 may be generally strip shaped, single layer/multilayer structure adapted to be held by the user.

Each of the side edges 212 and 214 of the gripping region 222 has a smoothness higher than a smoothness of the remaining part of the gripping regions Such a higher smoothness at the side edges 212, 214 is achieved by using any suitable mechanical mechanism already known in the art. Preferably, the mechanical mechanism includes crushing the side edges 212, 214. It was found that by crushing the paper-based material of the side edges of the gripping region, the side edges are smoothened and/or get a lower surface roughness, and therefore also obtain a lower cutting index. However, in other embodiments, the mechanical mechanism may include crimping, stamping, and embossing. Accordingly, the side-edges 212, 214 may be smoothened such that a thickness $T_G$ thereof, or at least of a top portion T, thereof is reduced at the gripping region 222 and is therefore lower than a thickness $T_A$ at the remaining portion of the gripping region or at the one or more attachment regions 224, 226.

Figure 5A:
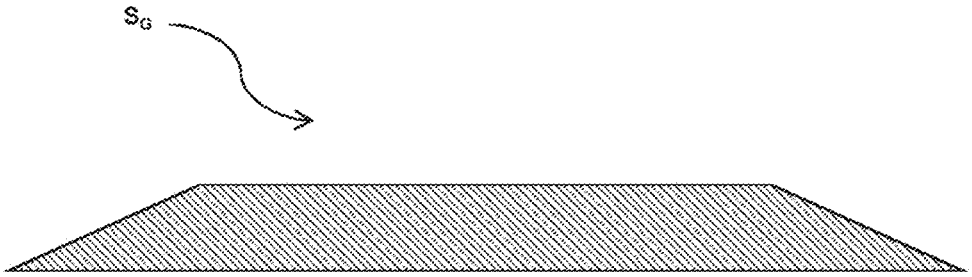
FIG. 5*a* illustrates a schematic diagram representing a cross-sectional shape of a handle having smoothened edges, in accordance with an exemplary embodiment of the present disclosure.
Figure 5B:
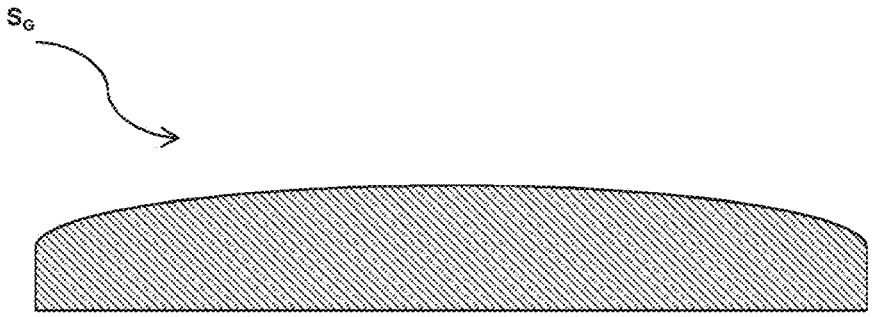
FIG. 5*b* illustrates a schematic diagram representing a cross-sectional shape of a handle having smoothened edges, in accordance with another exemplary embodiment of the present disclosure.

Accordingly, due to the smoothening operation, each of the side edges 212, 214 has a cross-sectional shape $S_G$ different at the side edges of gripping region 222 than at the remaining part of the gripping region and/or at the attachment regions 224, 226. In a preferred embodiment, as illustrated within the FIG. 5*a*, the shape $S_G$ is a generally right trapezoidal cross-sectional shape. Alternatively as shown in FIG. 5*b*, the shape $S_G$ is a generally semi-circular/D-shaped cross-sectional shape of the side edges 212, 214. In general, these shapes of the side edges 212, 214 at the gripping region 222 have an inclination or a slope from the side edges towards the remaining part of the gripping region, which in turn facilitates smooth edges that are comfortable and easy to grip without causing any pain/inconvenience to the user's hand. In other embodiments, the side edges 212, 214 may have any possible cross-sectional shape $S_G$ depending upon the mechanical mechanism used. In yet other embodiments of the present invention, the side edges 212, 214 of the gripping portion 222 may be smoothened in any desired shape such as for example, in a shape of finger grips, and the like. However, in all such embodiments, the shape $S_G$ should be such that it facilitates smooth edges that are comfortable and easy to grip.

Figure 4:
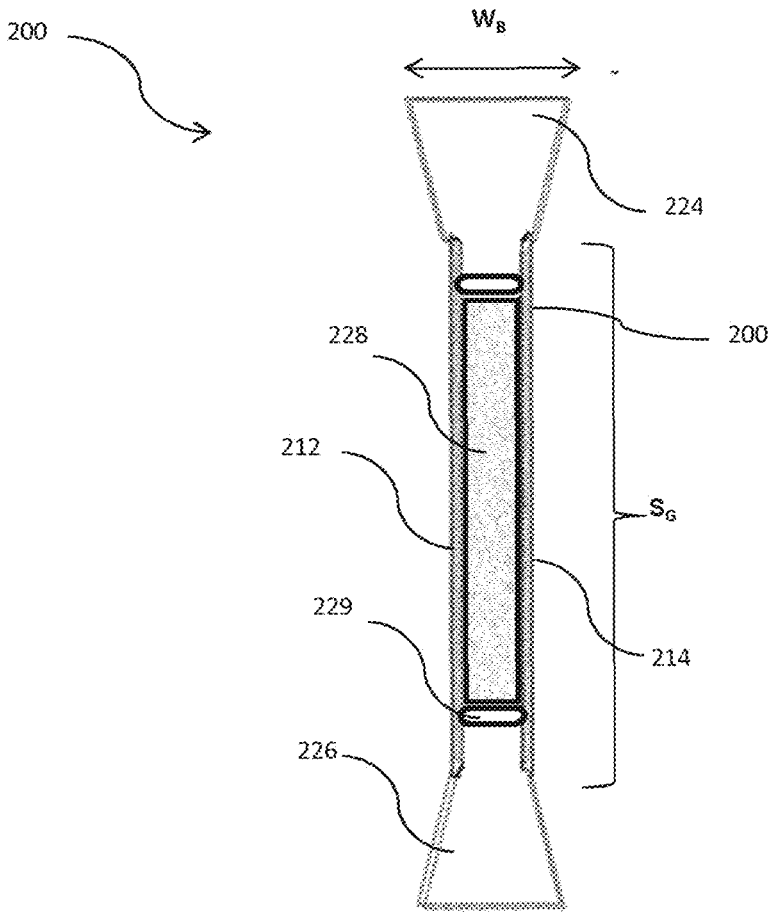
FIG. 4 illustrates top view of the handle having smoothened edges, in accordance with a preferred embodiment of the present disclosure.

In an embodiment of the present invention as illustrated in FIG. 4, the gripping region 222 includes a hand engaging region 228 extending between a pair of raised tactile features 229. The tactile features 229 are generally raised three-dimensional structure configured onto a top portion of the gripping region 222 and generally to facilitate prevention of movement of the user's hand away from the gripping region 222 and towards the attachment regions 224, 226. In a preferred embodiment, the tactile feature 229 may be formed by applying one or more varnishes in a pattern of a raised features of the same or different heights enough to restrict the movement of the hands there through. Alternatively, the tactile feature 229 may be formed by coating a tactile polymer composition having a blend of materials in accordance to the features as desired. For example, in an embodiment, the tactile coating material is a mixture of rubberized material (for cushion and tact), silica (for moisture control), and the like. Further, the composition may include one or more binders for making the tactile feature enduring and robust. The tactile polymer composition may further include one or more polymers and/or copolymers formed of various epoxy functional groups containing, acrylate monomer and the silicone macro monomer, vinyl monomers such as the vinyl styrene, vinyl acetate, vinyl propionate, vinyl benzoate, vinyl toluene, and various other polymers suitable for use in accordance with the features as required by the tactile feature.

In some embodiments, the gripping region 222 and/or the hand engaging region 228 may be coated at a lower surface 227 using a polymer material adapted to provide a cushioning impact to the user's hand. The polymer material may be selected from one or more of polymer material having generally softening properties selected from one or more of but not limited to group of polyethylene specifically low density polyethylene, polypropylene, polyester, in particular polyalkylene terephthalates and one or more polymers selected from polymer of said elastomeric film is selected from the group consisting of poly(ethylene-butene), poly (ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), and ethylene-propylene rubber, EPM (ethylene propylene rubber, a copolymer of ethylene and propylene) and EPDM rubber (ethylene propylene diene rubber, a terpolymer of ethylene, propylene and a diene-component), Epichlorohydrin rubber (ECO), Polyacrylic rubber (ACM, ABR), Silicone rubber (SI, Q, VMQ), Fluorosilicone Rubber (FVMQ), Fluoroelastomers (FKM, and FEPM) Viton, Tecnoflon, Fluorel, Aflas and Dai-El.

Alternatively, in some other embodiments, the lower surface 227 includes a cushioning pad affixed thereon adapted to provide a cushioning impact when held by the user.

In use, the handle 200 may be attached and/or lockingly receive within the one of the wall 282 at its attachment regions 224, 226, using one or more attachment mechanisms [not shown]. The attachment mechanism in such embodiments may be selected as one or more of but not limited to pocket-based connection mechanism, notch-based connection mechanism, stapling, gluing, adhesive patches, retention tab, stapling, rivets, and any other suitable mechanical attachment mechanism conventionally known in the art and suitable for use in current invention without deviating from the scope thereof.

While the illustrated embodiments display gripping portion 222 extending between two attachment regions namely, the first attachment region 224 and the second attachment region 226, it is to be contemplated that in some embodiments the handle 200 includes a single attachment region extended towards the gripping region 222 adapted to be attached/lockingly received within the secondary package 280.

In a modification of the first embodiment, the handle 200 is not attached directly to the secondary packages 280 but employed within a handle assembly 300, as illustrated in FIG. 3, which further may be used for facilitating handling of one or more secondary packages 280. The modified embodiment is particularly preferred for use in applications where the secondary packages is adapted for holding heavy weight items. Such an embodiment further distributes the load onto the walls 282 of the secondary package 280.

The handle assembly 300 includes a base portion 310 having a pair of handle pockets 312, and 314 configured onto an upper surface 313 thereof. The handle 200 is attached to the handle assembly 300 at its attachment regions 212, 214. such that each of the handle pocket slidingly and lockingly receives one of the attachment regions 212, 214. Accordingly, each of the attachment region 212, 214, in such embodiment is of a shape complimentary to the shape of each of the pockets 312, and 314 of the handle assembly 300. In use when the user lifts the handle 200, the gripping region 222 slidingly extends out and retracts back when released by the user.

Further, in such embodiments, the secondary package 280 is provided with one or more handle openings [now shown] configured within one or more of plurality of walls 282. The handle assembly 300 is generally adapted to be received and positioned within the inner surface 285 such that it is visibly accessible from the one or more handle openings.

In the preferred embodiment, the secondary package 280, including the handle assembly 300 and the handle 200 is formed of a single layer or a multilayered elongated piece of a recyclable material selected from but not limited to one or more of all kind of papers, fiberboard, corrugated board, any kind of hybrid material, and the like.

FIGS. 2 and 3 schematically show the arrangement of the basic components of the secondary package 280 employing the handle 200 of the present disclosure. However, in the construction of commercial functional units, secondary components such as couplers, connectors, support structure and other functional components known to one of skill in the field of packaging and more particularly the handling of packaging, may be incorporated within the secondary package 280. Such commercial arrangements are included in the present invention as long as the structural components and arrangements disclosed herein are present.

The secondary package 280, as illustrated in FIGS. 2 and 3, is an exemplary cuboidal shaped carton 281, in accordance with a preferred embodiment of the current disclosure. However, in other embodiments, the carton 281 may be of any other shape and having any number of sidewalls and/or handle openings on any wall, as desired without deviating from the scope of the invention.

In some embodiments, the handle 200 is attached directly to the carton 281 by using one or more attachment mechanisms selected from but not limited to but not limited to pocket-based connection mechanism, notch-based connection mechanism, stapling, gluing, adhesive patches, retention tab, stapling, rivets, and any other suitable mechanical attachment mechanism. [0075]. In other embodiments, the handle 200 is attached onto the handle assembly 300 which in turn is positioned within the inner surface 285 of the carton 281 such that the gripping portion 222 of the handle 200 is accessible from the handle opening/elongated slots of the carton 281. Further in such embodiments, in some instances, the handle assembly 300 may be fixed onto the inner surface of the carton wall 282 using one or attachment mechanism as already disclosed. In other embodiments, the handle assembly 300 may be simply placed onto the top of items placed within the carton 281.

As may be seen, in the above disclosed method, the handle 200 having smoothened edges 212, 214, is formed first and then assembled within the secondary packages 280. However, in some embodiments of the present invention, handle is first assembled into the secondary packaging 280 using a method as disclosed in step 708. Thereafter, the side edges 212, 214 of the gripping region 222 are smoothened using a method as disclosed in step 606.

In yet other embodiments of the present inventions, each of the step of the method 700 may be performed in any desired order, sequentially, and/or simultaneously.

INDUSTRIAL APPLICABILITY

The present disclosure relates to a handle 200 having smoothened edges, for facilitating comfortable and easy holding a secondary package 280 enclosing and securely carrying various items such as food items, house hold items, and any other group of items packed together as a group. Primarily, the secondary packaging is utilized for holding liquid containers, such as beer, wine, cider, hard liquor (e.g., distilled beverage, spirit, liquor, hard alcohol, etc.), soft drinks (e.g., cola, soda, pop, tonic, seltzer), iced tea, soda water and other types of carbonated/non-carbonated beverages. The handle while being cost-efficient and portable, is very quick and easy to be assembled by the retail consumers, or by the retailers, and offers an easy yet comfortable shipping, handling and transporting of packages of any shape, size or any variety of configurations. While the secondary package 280 is described primarily for holding and carrying beverage containers, it is also contemplated for a person skilled in the art that the secondary package 280 of the current disclosure may be implemented in various industries such as food industry, retail industry, transport industry, house hold appliance industry in transportation of any kind of product or group of products, of any shape, size or any variety of configurations, without limiting it to the beverage industry.

As should be appreciated, the realization of such a handle 200 for the secondary packages allows the end consumer to safely, easily and comfortably pick up and carry the cartons/carry bags having a plurality of items stored therein. Further, since the handle 200 is formed using currently existing handles by smoothening the gripping region 222, and since the handle 200 may be a multilayer structure, offers further increase the strength of the handle without requiring hard edges to cause any discomfort to the user. Additionally, the presence of raised tactile features 228 avoids any possibility of accidental movement of the user hands towards the hard-edged surface of the handle 200 and therefore prevents any kind of discomfort to the user while carrying secondary packages 280 employing handles 200 of the current disclosure.

While the flexible handle 200 of current disclosure has been disclosed in reference to the secondary package 280 of the current disclosure. it may also be used as an independent self-sustaining unit. Further it can be integrated with various suitable containers/cartons/bags, known in the art including various carton formed from foldable blank as well as cartons constructed of materials such as fabric, woven material, non-woven material, woven metallic fabric that may include ferrous or nonferrous metals, etc., or any other suitable material. In such embodiments too, the handle 200 of the current disclosure may be used to securely carry the secondary package 280 without deviating the scope of the current disclosure.

Further, while the currently illustrated exemplary secondary package discloses a single handle, it is to be contemplated that any number of handles, on any of the wall of the secondary package including the top wall and the bottom wall may be realized in accordance with the design constraints without deviating from the scope of the current disclosure. For example, in case of paper bags, the handle 200 may be attached to opposite sidewalls to facilitated comfortable gripping and carriage of the bags.

We claim:

1. A secondary package comprising a handle, wherein the secondary package comprises a carton and/or a bag; wherein the handle comprises:

a body portion formed of a piece of material having a pair of side edges defining a width thereof; the body portion comprising:

a gripping region extending towards and/or between a first attachment region and/or a second attachment region, wherein each of the side edges of the gripping region has a cutting index lower than the cutting index of the remaining part of the gripping region, wherein the side edges of the gripping region have a smoothness higher than the smoothness of the remaining part of the gripping region, wherein the side edges of the gripping region have a surface roughness lower than the surface roughness of the remaining part of the gripping region, wherein the side edges have a thickness lesser than the thickness of the remaining part of the gripping region, and wherein the side edges of the gripping region is smoothened using crushing or crimping.

2. The handle of claim 1, wherein the side edges of the gripping region may be inclined towards the remaining part of the gripping region.

3. The handle of claim 2, wherein the side edges of the gripping region may have a generally right-trapezoidal cross-sectional shape.

4. The handle of claim 2, wherein the side edges of the gripping region have a generally semi-circular cross-section sectional shape.

5. The handle of claim 1, wherein the gripping region comprising a hand engaging region extending between a pair of raised tactile features adapted to facilitate prevention of movement of a user's hand away from the gripping region.

6. The handle of claim 5, wherein the tactile feature comprising a raised structure formed by coating using a predetermined material selected from one or more of but not limited to one or more varnishes and/or a tactile polymer composition.

7. The handle of claim 1, wherein the body portion is made of a material selected from but not limited to all kind of paper, cardboard, carton, fiber board, corrugated carton, and the like.

8. A secondary package comprising a handle of claim 1, wherein the secondary package comprising a carton and/or a bag formed of a material selected from paper, paperboard, fiberboard, cardboard, corrugated board.

* * * * *